United States Patent [19]

Marr, Jr.

[11] 4,319,632

[45] Mar. 16, 1982

[54] OIL RECOVERY WELL PARAFFIN ELIMINATION MEANS

[75] Inventor: Andrew W. Marr, Jr., Ardmore, Okla.

[73] Assignee: GKJ, Inc., Lone Grove, Okla.

[21] Appl. No.: 127,901

[22] Filed: Mar. 6, 1980

Related U.S. Application Data

[63] Continuation-in-part of Ser. No. 100,704, Dec. 4, 1979.

[51] Int. Cl.[3] ..... E21B 36/04; E21B 43/24

[52] U.S. Cl. ..... 166/60; 166/52; 166/241; 166/272

[58] Field of Search ..... 166/60, 65 R, 248, 272, 166/302, 303

[56] References Cited

U.S. PATENT DOCUMENTS

| | | | |
|---|---|---|---|
| 1,764,213 | 6/1930 | Knox | 166/60 |
| 2,244,255 | 6/1941 | Looman | 166/302 |
| 2,368,777 | 2/1945 | Price | 166/65 R X |
| 2,982,354 | 5/1961 | Green | 166/60 |
| 3,507,330 | 4/1970 | Gill | 166/248 |
| 3,614,986 | 10/1971 | Gill | 166/60 X |
| 4,127,169 | 11/1978 | Tubin et al. | 166/60 X |

*Primary Examiner*—James A. Leppink
*Assistant Examiner*—George A. Suchfield
*Attorney, Agent, or Firm*—Berman, Aisenberg & Platt

[57] ABSTRACT

At least a portion of an oil-recovery well casing adjacent an oil-bearing earth formation is heated by the passing of an electrical current therethrough. The heated casing heats any oil entering therein. Paraffin found in the heated oil is thus maintained in a liquefied state thereby substantially reducing paraffin buildup in the oil-recovery well.

4 Claims, 3 Drawing Figures

OIL RECOVERY WELL PARAFFIN ELIMINATION MEANS

RELATED APPLICATION

This application is a continuation-in-part of application Ser. No. 100,704, entitled "Injection Well With High-Pressure High-Temperature In Situ Down-Hole Steam Formation", filed Dec. 4, 1979 (hereinafter referred to as the parent application). The entire disclosure of the parent application is herein incorporated by reference.

BACKGROUND OF THE INVENTION

The present invention relates to recovering oil from oil-recovery wells and, in particular, to eliminating or reducing paraffin accumulation in the well.

For many years paraffin accumulation in casings and other associated elements of oil-recovery wells has plagued those in the oil industry. The accumulation of paraffin interferes with an efficient recovery operation which must be interrupted for periodic paraffin removal.

Paraffin buildup has previously been eliminated by pumping oil, which had been heated at ground level, down into the well. The heated oil has the effect of liquefying paraffin. The heated oil and liquefied paraffin are then withdrawn from the well, thereby flushing the well clear of any paraffin buildup. Typically, large steam boilers at ground level are required to heat oil utilized in such a paraffin-flushing process. In an active well paraffin buildup may have to be eliminated on a weekly basis, thus adding to the cost of oil recovery as well as increasing "down time" of an oil recovery process.

It is an object of the present invention to eliminate paraffin from oil-recovery wells in a more time and cost efficient manner.

It is a further object of the present invention to heat oil as it enters an oil-recovery well and to eliminate any need for subsequent flushing to the well with heated oil.

These and other objects of the present invention are readily apparent from the following discussion.

SUMMARY OF THE INVENTION

An oil-recovery well of the present invention includes a bore hole having a perimeter and extending from ground level into or adjacent an oil-bearing earth formation. A casing extends along the bore perimeter from ground level to an elevation at or below the oil-bearing earth formation. Furthermore, means are provided for heating the casing and consequently any oil passing adjacent to such casing or through perforations therein. Heating recovered oil will liquefy, to a substantial degree, paraffin found therein or paraffin which has accumulated in the well. The liquefied paraffin is withdrawn from the recovery well along with the heated oil.

DETAILED DESCRIPTION OF THE INVENTION

Figure 1:
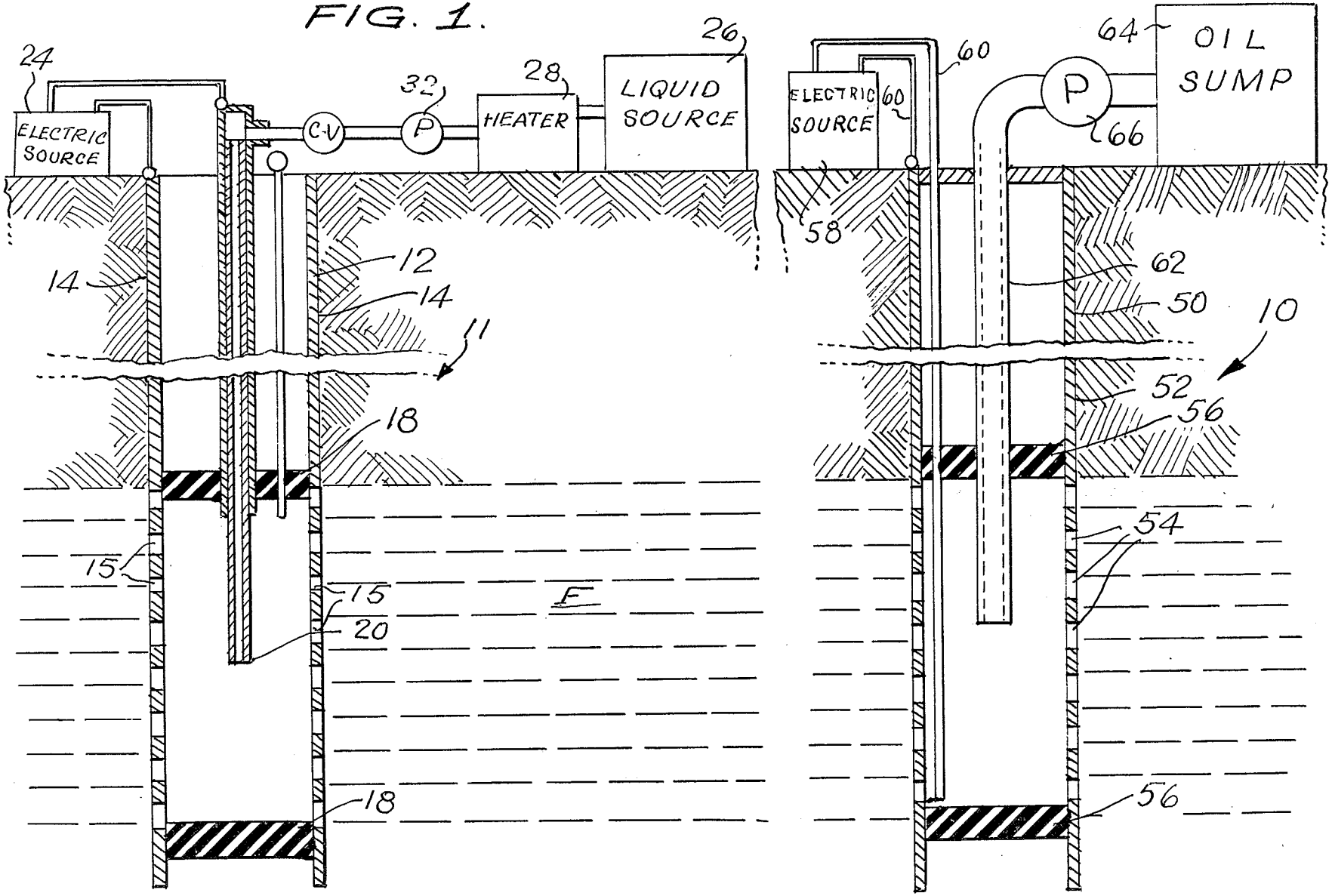
FIG. 1 is a schematic vertical partially-cross sectional view of a first embodiment of an oil-recovery well of the present invention utilized in conjunction with an injection well.

Like reference numerals represent identical or corresponding parts throughout the several views. Referring specifically to FIG. 1, the oil-recovery well of the present invention is generally designated as 10, and is depicted in conjunction with an injection well 11. The operation and operating components of injection well 11 are substantially the same as that described in the parent application.

Briefly, the injection well comprises a bore hole 12 with a casing 14 extending therethrough. Casing 14 is of an electrically-conductive material extending from ground level to a level adjacent to or below that of an oil-bearing earth formation F. A plurality of perforations or openings 15 are provided in casing 14.

A pair of spaced-apart sealing plugs 18 are disposed within casing 14 to define a portion of bore hole 12 therebetween. Also, an electrode 20, disposed within the bore opening 12 extends from above ground level to a level intermediate the two sealing plugs 18.

An electric source 24 is in electrical contact with casing 14 at one polarity terminal and is further in electrical communication with electrode 20 at the other polarity terminal.

A liquid, such as water, from source 26 is preheated by heater 28 and driven by pump 32 into the portion of injection well 11 defined between sealing plugs 18.

As water fills the space between the sealing plugs 18, an electric current is generated from source 24 through electrode 20, through the liquid and then returned by means of casing 14. The resistive heating of the electrode 20 vaporizes the water into steam either in the space defined by sealing plugs 18 or in the oil-bearing earth formation itself. The effect of the increased pressure and temperature from the steam drives the oil from the earth formation F into the recovery well 10 of the present invention.

While one embodiment of an injection well is heretofore described, it is nevertheless anticipated that oil recovery well 10 can be used in conjunction with other injection well embodiments.

Recovery well 10 includes a bore hole 50 having a perimeter and extending from ground level into or adjacent oil-bearing earth formation F. An electrically-conductive hollow casing 52 is adjacent to and extends along the perimeter of the bore hole 50. Casing 52 extends from ground level to a level at or below the oil-bearing earth formation F. At least a portion of the casing 52 adjacent the oil-bearing earth formation F comprises perforations 54.

A pair of spaced-apart sealing plugs 56 are disposed within the casing 50, one at an elevation above and the other at an elevation below at least a portion of the oil-bearing formation. The sealing plugs 56 are preferably effective in sealing a defined zone of the casing 52 to a high range of pressure requirements.

At least some of the oil driven from the oil-bearing earth formation by the pressure and temperature effects of in situ steam generation flows through the perforations 54 and into the region of the casing 52 defined between sealing plugs 56. However, in the recovery operation of the oil-recovery well 10 an electric current is generated through at least a portion of the casing 52 which comes in contact with or is adjacent to the recovered oil. Resistance to the electric current flow through the casing 52 manifests in the heating of the casing and consequently results in the heating of the recovered oil. This eliminates paraffin build-up in performations 54 of casing 52. It should be apparent that while substantially all of the casing 52 can be heated by the flow of a current therethrough, the heating of only a portion of the casing 52 may be required in order to heat the recovered oil. The oil is heated to a temperature at or above the melting point of paraffin to maintain contained paraffin in a liquid state and thus to preclude paraffin accumulation in the casing and in its associated components.

In the embodiment of the oil-recovery well 10 as shown in FIG. 1, an electric source 58, typically at ground level, is in electrical contact with the casing 52 in the vicinity of ground level and is in further electrical contact with the casing at a point adjacent to the lower sealing plug 56. However, it is clear from the previous discussion that electrical contact to casing 52 can be made at other locations thereon, as long as the recovered oil is sufficiently heated. Typically, electrical contact between the electric source 58 and casing 52 is by means of cables 60, each having an electrically-insulating jacket.

The recovered oil is removed from that portion of the casing 52 defined between sealing plugs 56 by means of a recovery conduit 62 which extends therein and to an oil sump 64. A conventional pump 66 draws the recovered oil up through the conduit 62 and to the oil sump 64.

In operation of the present invention, that portion of the casing through which the current passes is resistively heated to a temperature range of from 200° to 1,000° F. (93° to 538° C.). However, in order to eliminate the possibility of paraffin buildup, it is preferable that the recovered oil be heated to a temperature ranging from 60° to 325° F. (16° to 164° C.).

Typically, the electric source 24 is a transformer of the three-phase isolation variety having, for example, a primary of 12,500 volts, three-phase 60 Hz., 2200 KVA with two isolated secondaries, each of 155 volts, three-phase 700 KVA. The electric source 58 is alternatively of other conventional types, such as those described in the parent application, but with less KW, typically, 25 KW.

Either AC or DC current is used in operating the present invention; however, DC current is preferred. DC current is the best source of supplying electrical energy downhole for the recovery of oil at least on existing wells because of the loss of the return current in the casing 52. There is a possibility that AC current, at least flowing through existing wells, may cause the rupture of the casing, which may not be able to withstand the current. AC current is probably more suitable when the casing is of a very highly-conductive material, such as stainless steel, and further when the casing is stretched as it is disposed into the bore hole; otherwise, there is a tendency for the casing 52 to rise up from the ground due to the heat and current flowing therethrough.

Figure 3:
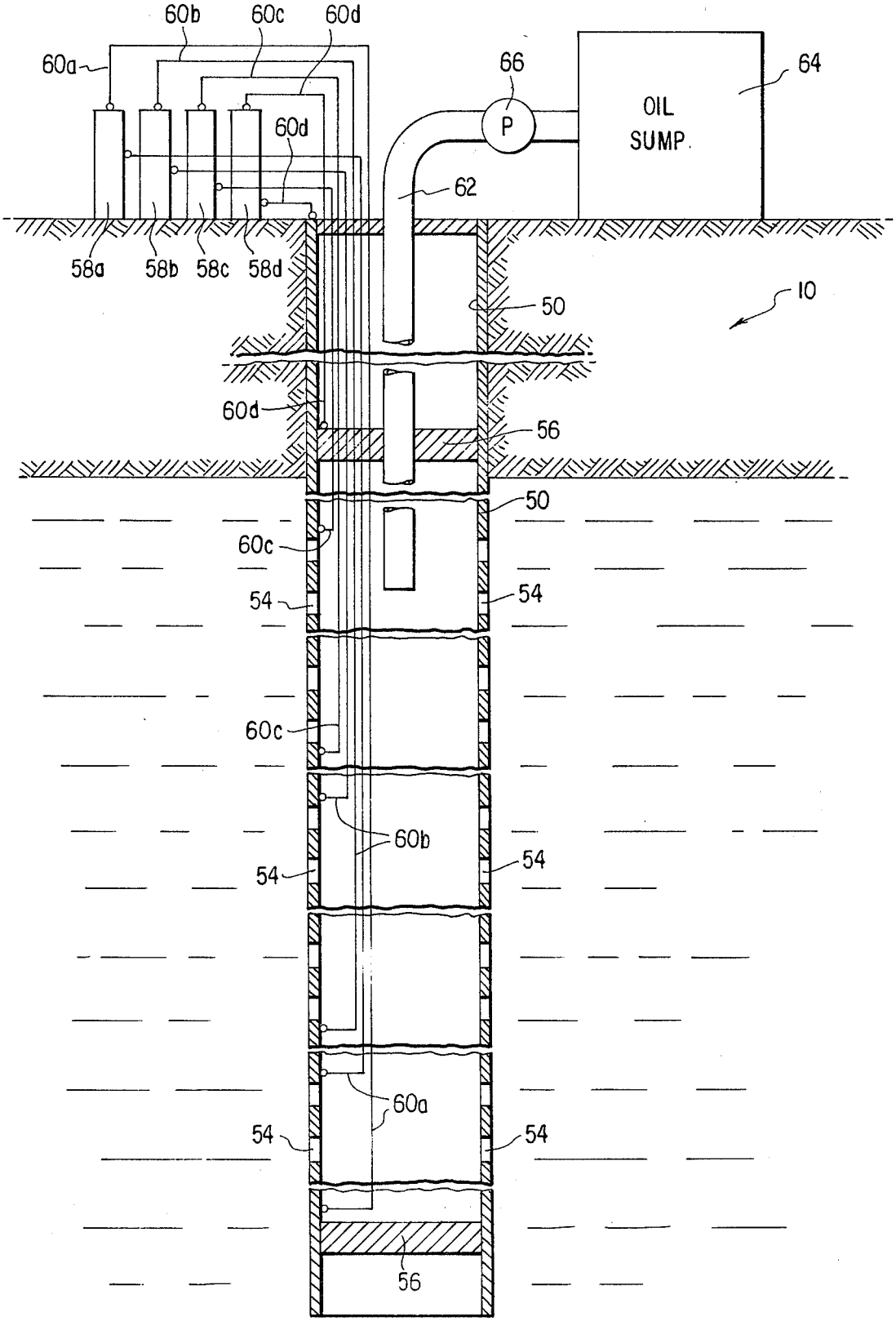
FIG. 3 is a schematic vertical partially cross sectional view of the oil recovery well utilizing a plurality of electric power sources and cables, each cable attached to a different longitudinal portion of the well casing.

While the present invention has been shown in FIG. 1 as having only one electric source, a plurality of electric sources are optionally utilized as shown in FIG. 3. Individual electric sources 582*a–d* provides an electrical current through a portion of the casing 52. For example, separate electrical sources are optionally utilized to deliver current through an electrical casing 52; a first electrical source 58*a* drives current through the casing from approximately ground level to about 600 feet by cable 60*a*, a second electrical source 58*b* drives current from approximately 600 feet to approximately 1500 feet through cable 60*b*, a third electrical source 60*c* drives current from approximately 1500 feet to 4000 feet, through to cable 60*c* and a fourth electrical current source 58*d* drives current through cable 60*a* to the casing from a level of approximately 4000 feet to a level of approximately 10,000 feet.

The voltage required in the operation of the present invention will depend on the depth of the well, but may typically be in the range of of 8 volts to 125 volts. For example, in the operation of a well approximately 15,000 feet down and producing 30 barrels of oil per day, approximately 125 volts will be required to heat the casing 52.

Figure 2:
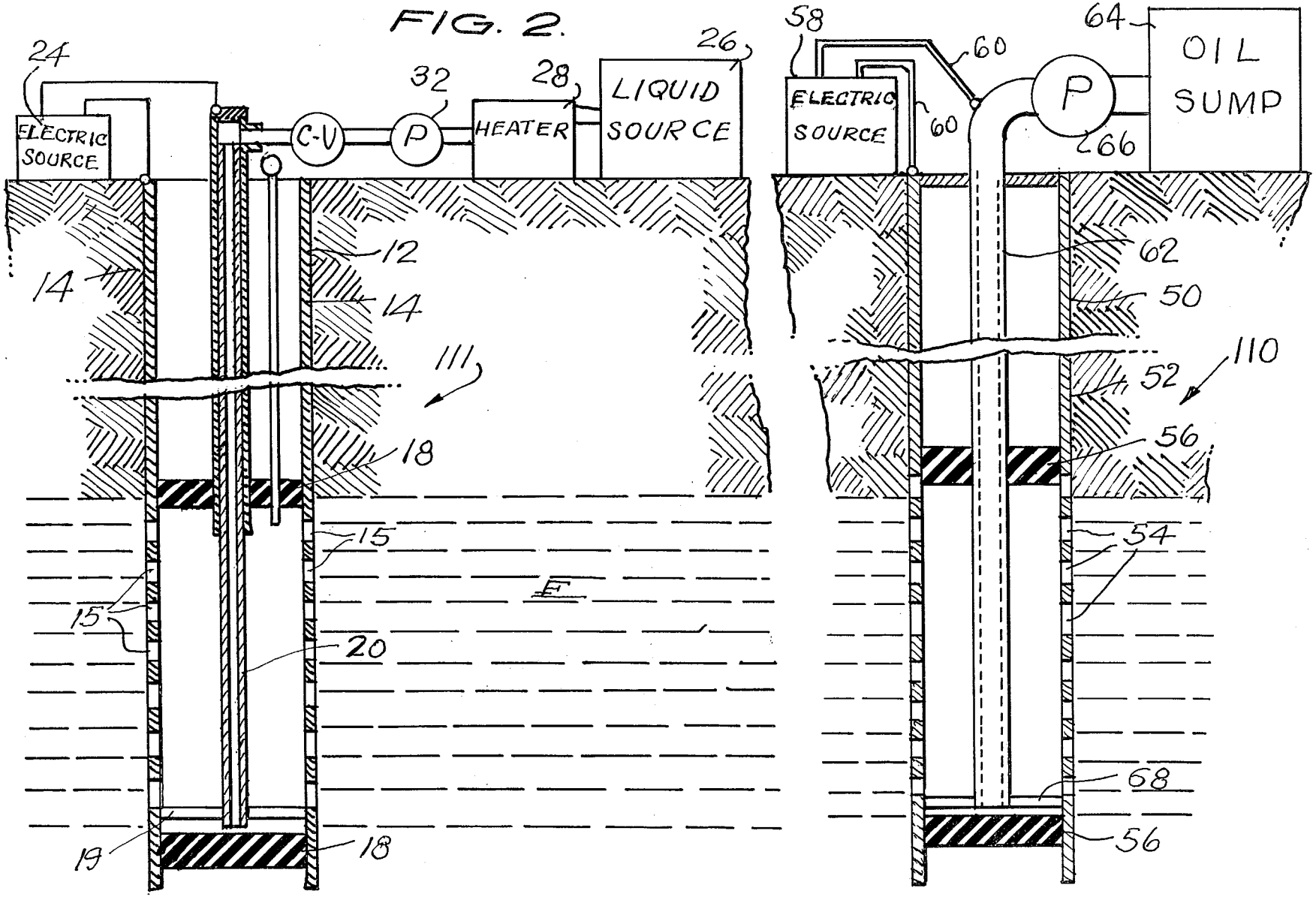
FIG. 2 is a schematic vertical partially-cross sectional view of a second embodiment of the oil-recovery well utilized in conjunction with another embodiment of the injection well.

Referring to FIG. 2, a second embodiment of the oil-recovery well of the present invention is designated as 110. In oil-recovery well 110, the electric source 58 makes electrical contact to the casing 52 in the vicinity of ground level, and also makes electrical contact with the recovery conduit 62. Electrical contact in both instances is by means of cables 60. Recovery conduit 62 is of an electrically conductive material so that an electric current can be conducted therethrough. Recovery conduit 62 extends into the well at some elevation between the sealing plugs 56, and typically extends to an elevation in the vicinity of the lower elevation sealing plug 56. An anchor 68 engages the recovery conduit 62 as it extends towards the lower elevation plug 56, and anchors it to the casing 52. Anchor 68 may be in the form of a tube, and is preferably of an electrically conductive material, such as metal. Thus, anchor 68 completes the electrical current path between the casing 52 and the recovery conduit 62.

The casing 52 and the recovery conduit 62 are heated by the flow of a current therethrough. Consequently, the recovered oil and the contained paraffin will be heated as it makes contact with or comes in the vicinity of casing 52 and recovery conduit 62. In all other aspects, the operation of the second embodiment of the oil-recovery well will be the same as the first embodiment heretofore discussed.

FIG. 2 also shows an alternative embodiment of the injection well, generally designated as 111. In alternative embodiment 111, electrode 20, like recovery conduit 62 of the oil-recovery well 110, is anchored to casing 14 by means of an anchor 19. Preferably, the anchor 19 is of an electrically conductive material, such as metal, to provide a path for electrical current between the electrode 20 and the casing 14. Anchor 19, like anchor 68, is typically in the form of a tube.

In all other aspects, the operation of the oil injection well 111 is the same as that of the embodiment heretofore described.

It is apparent from the preceeding discussion of the recovery well of the present invention that a much needed solution to the problem of paraffin accumulation is herein provided.

While this invention has been defined with respect to embodiments thereof, it is not limited thereto. The appended claims therefore are intended to be construed to encompass all forms and embodiments of the invention within its true spirit and full scope.

What is claimed is:

1. An injection well comprising:

a bore hole having a perimeter and extending from ground surface level into or through an oil-bearing earth formation, a casing being an electrically-conductive hollow casing extending along the perimeter of the bore hole from ground surface level to a level at or below the oil-bearing earth formation and having multiple perforations throughout a portion thereof adjacent the oil-bearing earth formation, seallng means being two spaced-apart high-pressure-resistant plugs sealing the casing, the first such plug being at an elevation above and the second plug being at an elevation below at least a portion of the oil-bearing earth formation, electrode means comprising means to conduct current into the bore hole from ground surface level through the first plug to a lower extremity in the space between the two plugs, said electrode means being externally electrically insulated from the ground surface level to and including the level of the first plug, but to a level which is significantly higher than the lower extremity, connecting means electrically connecting said electrode to said casing, said connecting means being disposed at an elevation between said two spaced-apart plugs, liquid conduit means comprising means to conduct a liquid pressure means comprising means to supply a liquid at a pressure of at least 400 psi to the space between the two plugs, and an electric-power supply comprising means to produce an electric current flow through said casing, said connecting means and said electrode.

2. An injection well according to claim 1 wherein said connecting means is a means for anchoring said electrode means to said casing.

3. An injection well according to claim 2 wherein said anchor means is tubular in structure.

4. An oil-recovery well comprising:

a bore hole having a perimeter and extending from ground surface level into or adjacent an oil-bearing earth formation;

an electrically-conductive casing extending along the perimeter of said bore hole from ground surface level to a level at or below the oil-bearing earth formation;

means for heating oil entering said casing to a temperature above the melting point of paraffin contained in said oil, said heating means being electric heating means in electrical contact with said casing, said electric-heating means being adapted for causing an electric current to flow through at least a portion of said casing, thereby heating oil entering therein, and further to reduce paraffin deposits on said casing from entering oil;

said electric heating means being an electric-power supply making a first electrical contact with said casing at ground level and a second electrical contact with said casing at an elevation below at least a portion of the oil-bearing earth formation, said first and second electrical contacts from the electric-power supply to said casing being by means of electrically-conductive cables having electrical insulation jackets thereon; and means to withdraw thus heated oil and liquefied paraffin from said oil-recovery well.

* * * * *